US005184427A

United States Patent [19]

Armstrong

[11] Patent Number: 5,184,427

[45] Date of Patent: Feb. 9, 1993

[54] BLAST CLEANING SYSTEM

[75] Inventor: Jay Armstrong, Westlake, Ohio

[73] Assignee: James R. Becker, No. Ridgeville, Ohio ; a part interest

[21] Appl. No.: 589,042

[22] Filed: Sep. 27, 1990

[51] Int. Cl.[5] ..... B24B 49/00

[52] U.S. Cl. ..... 51/165.73; 51/321; 51/410

[58] Field of Search ..... 51/321, 322, 320, 410, 51/165.73

[56] References Cited

U.S. PATENT DOCUMENTS 4,389,820 6/1983 Fong ..... 51/320 X 4,617,064 10/1986 Moore ..... 51/320 X

*Primary Examiner*—M. Rachuba

*Attorney, Agent, or Firm*—J. Helen Slough

[57] ABSTRACT

This invention relates to carbon dioxide blase cleaning system. In the present invention, the propelling of the dry-ice pellets is provided by cryogens, namely liquid nitrogen and/or liquid oxygen supplied under high pressure. In a preferred embodiment liquid carbon dioxide pellets are placed into a pellet hopper and a portable liquid nitrogen and/or liquid air storage tank is employed. The pellet hopper and the blast unit and blast gun(s) are located at the blast site, the portable cryogenic liquid nitrogen and/or liquid air tank with an ambient air vaporizer are located at or near the blast site. In this invention, as distinguished from the prior art, all the equipment and material for cleaning is located near the blast site and there is only one hose running to the nitrogen supply, there are no cables or hoses running to a truck air compressor or generator located away from the blast site. Pellets from the hopper are fed into the blast gun(s) through a blast unit. Cryogenic liquid nitrogen and/or oxygen is caused to pass through an ambient air vaporizer to vaporize the liquid gases and build such gases up to high pressure. The cryogenic gas under high pressure is then brought into the blast gun containing the pellets as aforesaid to effect propulsion of the pellets at high velocities through the gun nozzle to blast the surface or surfaces to be cleaned.

3 Claims, 3 Drawing Sheets

BLAST CLEANING SYSTEM

FIELD OF INVENTION

This invention relates to blast cleaning methods, and particularly to blast cleaning systems which use pellets of solid carbon dioxide.

BACKGROUND OF THE INVENTION

Solid carbon dioxide blast cleaning is used in place of abrasive blasting systems and other blast cleaning systems to remove paint or other coatings/contaminants from surface areas. Most blast cleaning systems generate additional waste material which must be removed after the blast cleaning operation has been completed. In sandblasting, for example, sand is used as the blasting materials, and a residual of sand is left around the area that has been blast cleaned. Using a sublimable material, such as solid carbon dioxide, in blast cleaning operation is advantageous because no residual blasting material remains, since the solid carbon dioxide sublimates to become gaseous carbon dioxide upon impacting the surface or warming. For this reason solid carbon dioxide blast cleaning is the preferred method of cleaning surfaces in certain environments where removal of the residual is difficult or impossible.

An example of carbon dioxide blast cleaning system is shown in U.S. Pat. No. 4,617,064, issued Oct. 14, 1986, to Moore.

Currently available commercial systems commonly have several standard components, some of which are generally located on a large truck which is moved adjacent to the blast cleaning area, and along with other components that are located at the blast site. Components located at the blast site are connected to the components carried by the truck through various flexible hoses and electric cable. In such systems, the truck typically carries a portable carbon dioxide vessel and other necessary equipment and machinery. The small portable carbon dioxide vessel includes an air compressor, diesel or electric generator for power supply, pelletizer with air dryer and feed system, and accompanying high pressure hose equipment. A large external carbon dioxide storage vessel (supply) is employed in such systems and is normally six (6) tons or greater in capacity. Since the rate of carbon dioxide usually varies between 500 pounds per hour to 1500 pounds per hour, the large external carbon dioxide storage vessel, which is supplying the smaller portable carbon dioxide vessel, may require filling more than once per day.

The air compressor employed is commonly a screw-type, having a rating of air flow at a range up to 500 cubic feet per minute at maximum pressures of around 250 PSI. An external power supply is required and a power supply of at least 70 amps and 220/460 volts is commonly utilized. Such external power is normally supplied by a portable generator located on the truck.

Located remotely therefrom at the blast site in such systems are a portable vessel containing liquid carbon dioxide, a pelletizer, an air dry, and a blasting gun having a nozzle to direct the pellets. A portable carbon dioxide vessel normally holding approximately two tons is filled from a large carbon dioxide storage vessel on the truck. The portable carbon dioxide vessel is adapted to be wheeled or otherwise moved into the blast site when pelletizing equipment is utilized to turn the liquid carbon dioxide into small carbon dioxide pellets. The pelletizing equipment normally has a typical capacity rate of around 200–500 pounds per hour of dry-ice production. The pelletizer is operated by an electric power source through cables and flexible compressed air lines as referred to hereinbefore from a source of power supply and an air compressor mounted on the truck. Once pellets are made as stated, the same are delivered to a blasting gun attached to the pelletizer and driven by compressed air toward the surface to be cleaned.

The design of the pelletizer is well known in the art. A good description of the pelletizer is contained in the U.S. Pat. No. 4,617,064 issued Oct. 14, 1986 to Moore. Disclosure of this patent is hereby incorporated by reference. As stated above, a large liquid carbon dioxide storage tank is carried on the truck, but said tank could also contain liquid air or other liquifiable gas, which when vaporized can produce high pressure propellants.

Compressed air is carried from the compressor mounted on the truck by the flexible hoses or cables to the blasting gun area after first passing through an air dryer normally located at the blasting site. The air dryer operated to lower the dew point of the compressed air down to −40 degrees Fahrenheit, to prevent water vapor from causing problems during the blasting process.

The above described currently available system has several inherent disadvantages. First, a multiplicity of lines, both air and electrical must be run from the truck located outwardly of the blast area.

Secondly, available pressure from a conventional air compressor is limited to 250 pounds per square inch. The use of such commercial air compressors is not only difficult in operation but expensive.

Thirdly, the system ties the pelletizing machinery directly to the blast mechanism at the blasting site creating problems due to space limitations at the blasting site and requires that the components act as one unit rather than independently of one another.

Further, in the commercially available systems discussed hereinbefore, reduction of the moisture level of the incoming air down to a dew point of about −40 degrees F. is necessary.

The object of the present invention is to produce a carbon dioxide blast cleaning system in which carbon dioxide pellets are instantly available and are located at the blast site for instant use.

A further object of the invention is to produce a CO2 blast cleaning system which is inexpensive in manufacture, being composed of fewer parts, and highly efficient in operation.

Another object of the invention is to eliminate the multiplicity of components located at a considerable distance from the blast site in the blasting operation.

Other objects of the invention and the invention itself, will become apparent from a purview of the appended description in which reference is made to the accompanying drawings

SUMMARY OF THE INVENTION

This invention relates to a carbon dioxide blast cleaning system. In the present invention, the propelling of the dry-ice pellets is provided by cryogens, namely liquid nitrogen and/or liquid oxygen supplied under high pressure. In a preferred embodiment liquid carbon dioxide pellets are placed into a portable pellet hopper and a portable cryogenic liquid nitrogen and/or liquid air storage tank is employed along with a portable blasting unit. The portable pellet hopper, the portable cryogenic liquid nitrogen and/or liquid air storage tank with an ambient air vaporizer and a blast unit and gun(s) are located near the blast site. In this invention, as distinguished from the prior art, all the equipment and material for cleaning, with the exception of the liquid $N_2$ and $O_2$ sources, is located at the blast site, thus requires only one cable or hose running to the blast site, there are no cables or hoses to an air compressor or generator located away from the blast site. Pellets from the hopper are fed into the blast unit and from there into the blast gun. Cryogenic liquid nitrogen and/or oxygen is caused to pass through an ambient air vaporizer to vaporize the liquid gases and build such gases up to high pressures. The cryogenic gas under high pressure is then brought into the blast gun which is being fed the pellets as aforesaid to effect propulsion of the pellets to high velocities through gun nozzles to blast the surface or surfaces to be cleaned.

DETAILED DESCRIPTION OF THE PREFERRED EMBODIMENT

Figure 1:
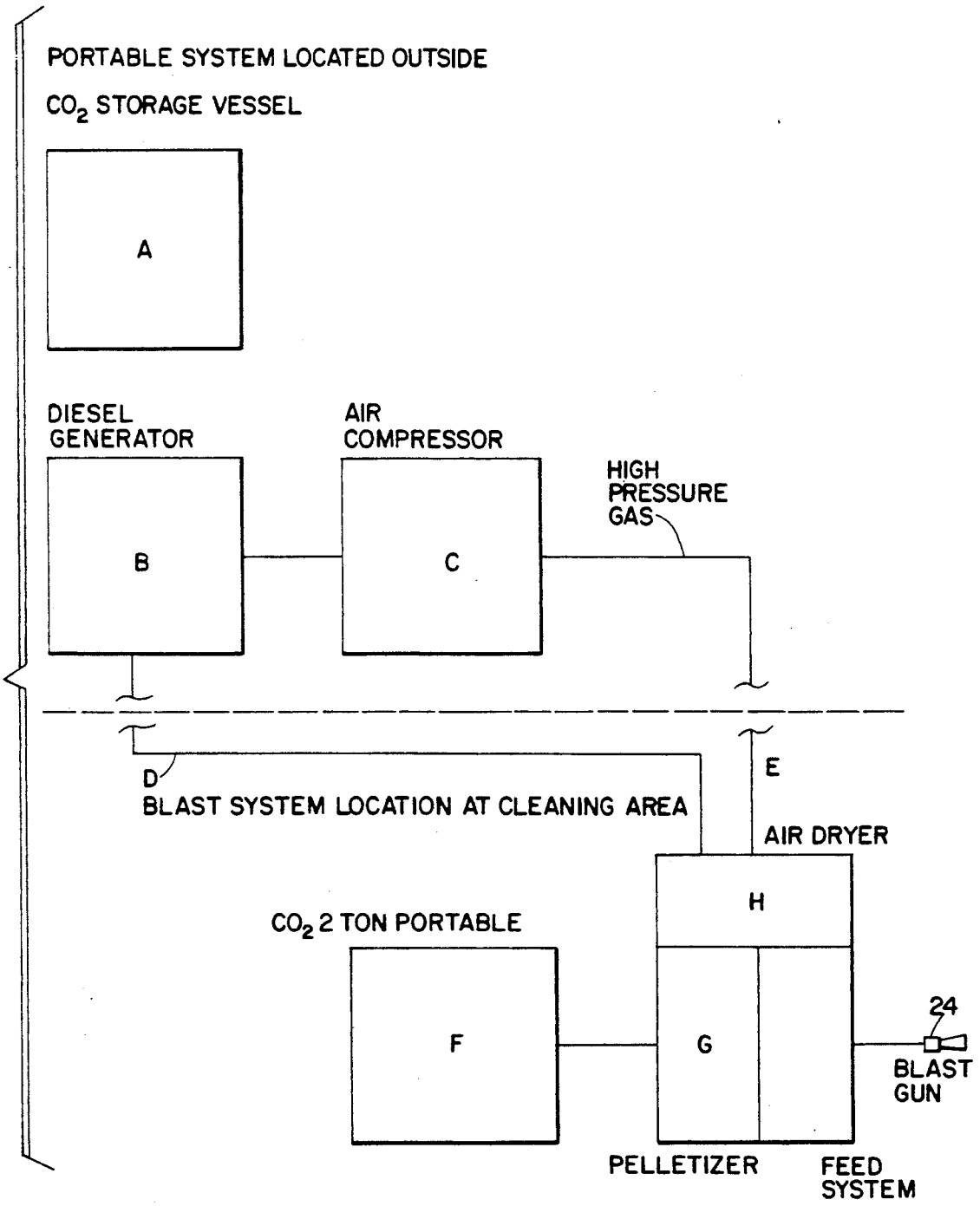
Fig. 1 (PRIOR ART)
FIG. 1 - A block drawing of the prior art.

Reference is now made to the figures of drawings, in all of which, like parts are designated by like reference numbers. FIG. 1, discloses a block diagram of the blast cleaning system of the prior art which typically uses a large truck (not shown), located remote from the blast site containing a large carbon dioxide storage tank A, typically six (6) tons or greater, a portable generator B, and an air compressor and air cooler C. At the blast site is a portable liquid carbon dioxide tank F, a pelletizer G, an air dryer H and a blast gun I. Running from the remote location to the blast sites are electrical lines, D, and hoses E.

Figure 2:
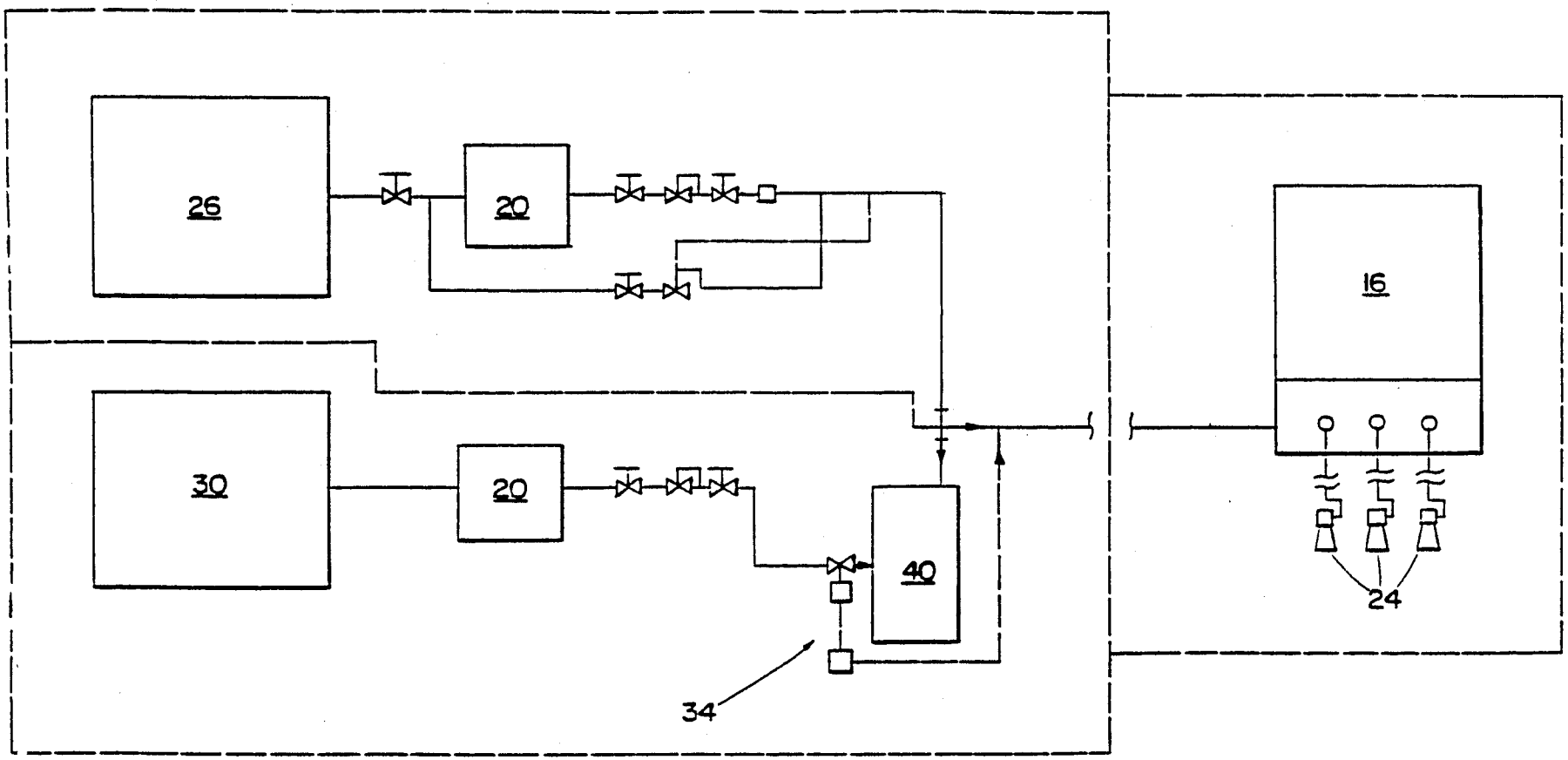
FIG. 2 - A block drawing of the components at or near the blast site of one embodiment of the invention.
Figure 3:
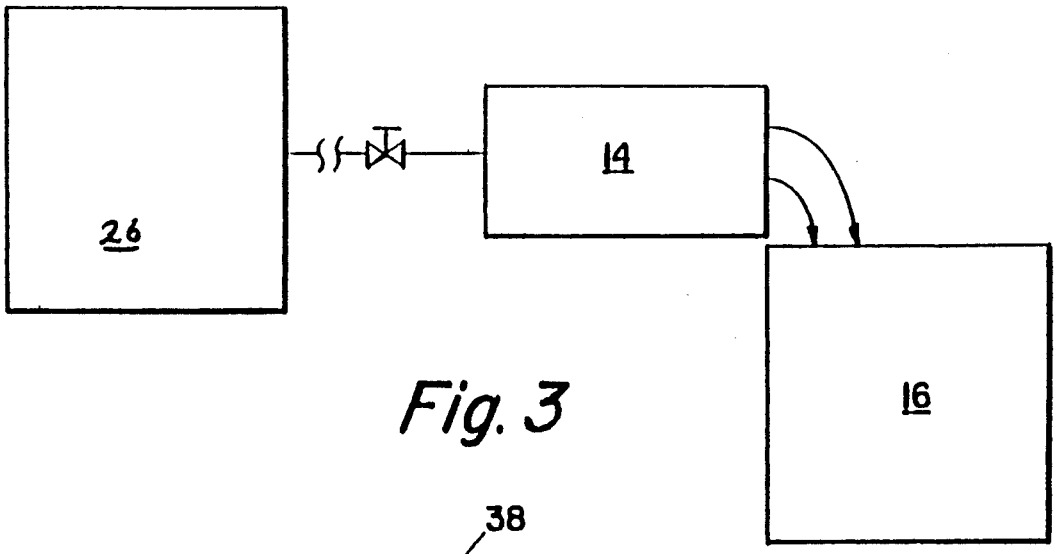
FIG. 3 - A block drawing of the components at a fixed site of one embodiment of the invention.

FIG. 2 is a block diagram of the present invention. In the present invention on the truck (not shown), remote from the blast site is a large liquid nitrogen tank. At the blast site is a portable storage hopper 16, with pellets of carbon dioxide and a blast unit and gun(s) 24. One can readily see by looking at FIG. 1, and FIG. 2, the present invention has only one line, namely a nitrogen line, and does not have any electric line or air hose running from the remote location to the blast site.

In contrast to the prior art, the present invention pelletizes the dry ice at the remote location where the pellets are placed into a pellet hopper 16, which is preferably portable and where the carbon dioxide pellets are stored until use. The said storage hopper 16, (as to use) permits the separation and independent use of the blasting mechanism and the pelletizing equipment. The portable hopper 16, also makes the pellets instantly available at the blast site. A portable storage hopper of the types described has been found to allow pellets stored in it to remain useful for up to three (3) days at a time. The storage hopper in a preferred embodiment is constructed of plastic and/or metal or other similar material and is suitably insulated.

In the present invention, the liquid nitrogen from the storage tank 26, is discharged through a portable ambient air vaporizer 20. The liquid nitrogen storage tank 26 discharges the liquid nitrogen into an ambient air vaporizer 20, which vaporizes the liquid nitrogen and builds up the liquid nitrogen into high pressure gaseous material and allows for control of the temperature of the material. The portable pellet hopper 16 permits the separation of the blasting equipment from the truck carrying the liquid nitrogen, requiring only one supply line to be run. There are no electric cables or air hoses running back to the truck.

As stated hereinbefore, the portable nitrogen storage vessel 26 is connected to an ambient vaporizer 20, allowing for the vaporization of the liquid cryogen and control of the temperature of the individual cryogen gases. The vaporizer 20 is adapted to supply high pressure gases such as nitrogen fully vaporized up to 3,000 pounds per square inch. The vaporizer 20, also can be used to mix liquid oxygen from an oxygen tank 30, as shown in FIG. 2, with nitrogen. The nitrogen from the vessel 26 can be mixed with the oxygen from the oxygen tank 30, to provide an output which only comprise high pressure air equivalence or 100% nitrogen or any combination in between, by mixing the nitrogen and oxygen and controlling the vaporization thereof, temperatures of the resulting high pressure gases may be controlled. The temperature of the output thus depends in part upon the mix nitrogen and oxygen and the resulting temperature may be anywhere between ambient down to −200° F. The high pressure gas is transferred from the ambient air vaporizer 20, to the blast gun 24, by a hose line which is preferably flexible to allow free movement of the blast gun 24. The pressure supply to the blast gun 24, can be varied from any amounts above 0 PSI to 500 PSI or greater and between 0 cubic feet per minute (CFM) to 500 (CFM) or greater, depending on the blasting requirement. These pressures will be able to propel the pellets at subsonic or supersonic velocities through the blast gun 24.

The pellet hopper 16, is also connected to the blast unit which is then connected to a blast gun(s) 24. The pellet hopper 16, supplies pellets of dry ice contained therein by means of gravity feed, vibration, vacuum and/or pressurized fluidization created by the gaseous nitrogen supply under pressure through rigid or flexible hose lines. These pellets of carbon dioxide flow, which flow rate is determined by the operator, through a rigid or flexible hose to the blast gun(s) 24. In the preferred embodiment the dry ice pellets are supplied at a controlled rate of up to approximately 12.0 lbs. per minute to the blast gun. The propellant is the high pressure nitrogen supplied to the blast gun(s) preferably by means of a separate hose line.

Figure 4:
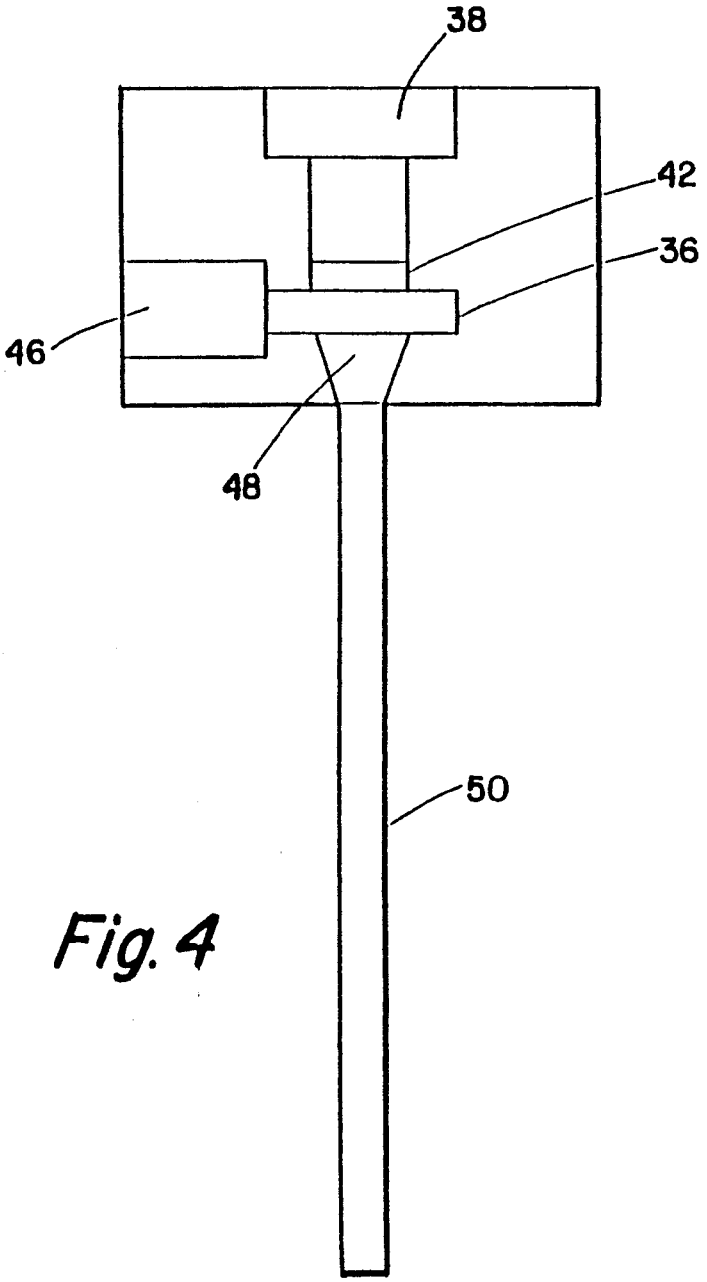
FIG. 4 - A block drawing of the blast gun.

The blast gun 24, as shown in detail in FIG. 4, is connected to a high pressure nitrogen line by means of a gas supply line connector 38, and to the pellet hopper and blast unit by means of supply line connectors 46. The gas moves from the supply line connector 38, through a removable and exchangeable venturi 42, which varies inlet pressure and flow with corresponding changes in the velocity at the barrel of the gun 50. From this venturi 42, the gas moves into mixing chamber 36. In said chamber the gas is mixed with pellets supplied from the pellet hopper 16 to the blast gun 24 and preferably the gas propels the pellets through a funnel shaped, or variations thereof, orifice 48, and forcibly ejects the same out through the barrel 50.

In the embodiment of the invention the propelling gas can be both liquid nitrogen and liquid oxygen. This embodiment is well suited for work in confined areas where there may not be enough oxygen for the operator to breathe. Another embodiment of my invention could use only liquid nitrogen as the propelling gas. In this embodiment only a portable nitrogen tank 26 is attached to the ambient air vaporizer 20. As in the previous embodiment the liquid nitrogen is turned into high pressure gas in the ambient air vaporizer 20.

In order to provide a closer temperature control of the high pressure gas supply from the ambient air vaporizer 20, a trim heater 40, may be provided. The output from the vaporizer 20, is then supplied to a trim heater 40 which includes an adjustable thermostat and fine tunes the temperature of the gas supply. Thus the trip heater can be used to control the temperatures to the gas at the blast gun 24.

A surge vessel 34 also monitors the oxygen levels in applications in which oxygen is required. In many applications oxygen will not be necessary, and the system may be run on 100% nitrogen.

Although several embodiments of this invention have been illustrated and described, it is to be understood that by one skilled in the art that numerous changes and modifications can be carried out in this invention shown and described without departing from the spirit and scope of the claimed invention. Accordingly, that scope of the invention is intended to be limited only to the scope of the appended claims.

What is claimed is:

1. A system for blast cleaning a surface with solid pellets of carbon dioxide, comprising:

means for storing a cryogenic supply of a liquified gas;

means for creating a high pressure gas from said liquified gas and for delivering a stream of said high pressure gas at temperatures between ambient and −200° degrees F.

means for storing solid pellets of carbon dioxide;

means for mixing said solid pellets of carbon dioxide into said stream of high pressure gas; and means for propelling the mixture of solid pellets and high pressure gas towards the surface to be cleaned.

2. A system for blast cleaning a surface with solid pellets of carbon dioxide, as in claim 1, further comprising a trim heater for controlling the existing temperature of a high pressure liquified gas which is a mixture of liquid nitrogen and liquid oxygen and further comprising a surge vessel attached to the trim heater for monitoring oxygen levels.

3. A system for blast cleaning a surface with solid pellets of carbon dioxide, as in claim 1, wherein said means for storing said supply of liquified gas and said means for creating a high pressure gas are at a first location, and said means storing said solid pellets and for mixing said solid pellets into said stream of said high pressure gas is at a second location remote from said first location.

* * * * *